US006478445B1

(12) United States Patent
Lange et al.

(10) Patent No.: US 6,478,445 B1
(45) Date of Patent: Nov. 12, 2002

(54) LIGHTING ASSEMBLY FOR A REFRIGERATION APPLIANCE

(75) Inventors: Scott W. Lange, Louisville, KY (US); Sooraj Puthiyaveetil, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,062

(22) Filed: Nov. 14, 2001

(51) Int. Cl.[7] ..... F21S 4/00

(52) U.S. Cl. ..... 362/223; 362/92; 362/311; 362/341; 312/116; 312/236

(58) Field of Search ..... 362/223, 296, 362/311, 341, 235, 246, 92, 294; 312/116, 236

(56) References Cited

U.S. PATENT DOCUMENTS 5,016,146 A 5/1991 Kaspar
5,283,721 A 2/1994 Powell
5,420,774 A * 5/1995 Wilson ..... 362/376
5,510,965 A * 4/1996 Taekell ..... 362/223
5,768,898 A 6/1998 Seok et al.
5,873,646 A 2/1999 Fjaestad et al.
5,967,648 A * 10/1999 Barnes, II et al. ..... 362/307
6,014,489 A 1/2000 Johanson
6,033,085 A * 3/2000 Bowker ..... 362/223
6,135,613 A * 10/2000 Bodell et al. ..... 362/223
6,149,285 A * 11/2000 Cicarelli ..... 362/255
6,386,736 B1 * 5/2002 Reiff et al. ..... 362/260

* cited by examiner

*Primary Examiner*—Thomas M. Sember
*Assistant Examiner*—Ronald E. DelGizzi
(74) *Attorney, Agent, or Firm*—Armstrong Teasdale LLP

(57) ABSTRACT

A light column assembly including a hollow tube, a first endcap, a first optical lighting film, a second optical lighting film, and at least one light source is provided. The hollow tube includes a rear wall having an inner surface, a front wall extending opposite the rear wall, a first end, and a second end. The tube front wall also has an inner surface. The first endcap is coupled to the tube first end and includes a reflective inner surface. The first optical lighting film overlies the tube rear wall. The second optical lighting film overlies the tube front wall. The light source is coupled to the tube second end and positioned to direct a light beam having a predetermined beam spread angle toward the first endcap such that the light source light is substantially evenly emitted from the tube through the tube front wall.

26 Claims, 3 Drawing Sheets

LIGHTING ASSEMBLY FOR A REFRIGERATION APPLIANCE

BACKGROUND OF INVENTION

This invention relates generally to lighting assemblies and, more particularly, to a lighting column assembly for a refrigeration appliance.

At least some known refrigeration appliances include a freezer compartment and a fresh food compartment. The freezer and fresh food compartments within these known refrigeration appliances typically include lighting devices having a lamp and a lamp socket such that, when the freezer compartment door or the fresh food compartment door is opened, the lighting devices are illuminated allowing a user to more easily see the contents within the compartments. A number of problems, however, have been noted with conventional refrigeration appliance light assemblies.

For example, in order to illuminate a typical refrigeration appliance, a plurality of lighting devices must be positioned at different locations within the freezer compartment and fresh food compartment. The fewer the lighting devices positioned within the refrigeration appliance, the greater the likelihood the freezer compartment or fresh food compartment will not be adequately illuminated. However, the greater the number of lighting devises positioned within the refrigeration appliance, the greater the cost to manufacture the refrigeration appliance.

Additionally, installing or replacing the lamps within a plurality of lighting devices positioned within a refrigeration appliance is often challenging due to the location of the socket, time consuming, and costly because of an increased number of parts.

Another problem is that at least some known refrigeration lighting assemblies do not distribute light evenly. Consequently, a greater number a lighting devices must be positioned with the refrigeration appliance or a more powerful lamp must be used. In either case, the cost to manufacture such a refrigeration appliance is increased.

SUMMARY OF INVENTION

In one aspect, a light column assembly including a hollow tube, a first endcap, a first optical lighting film, a second optical lighting film, and at least one light source is provided. The hollow tube includes a rear wall having an inner surface, a front wall extending opposite the rear wall, a first end, and a second end. The tube front wall also has an inner surface. The first endcap is coupled to the tube first end and includes a reflective inner surface. The first optical lighting film overlies the tube rear wall. The second optical lighting film overlies the tube front wall. The light source is coupled to the tube second end and is positioned to direct a light beam having a predetermined beam spread angle toward the first endcap such that the light source light is substantially evenly emitted from the tube through the tube front wall.

In another aspect, a light column assembly for a refrigeration appliance having an inner surface is provided. The light column assembly includes a light source, a hollow tube, a first endcap, and a second endcap. The light source includes a light beam having a predetermined beam spread angle. The hollow tube is positioned adjacent the light source and is positioned to direct the light source light into the tube. The tube includes a first end, a second end, a rear wall configured to evenly distribute the light source light from the tube first end to the tube second end, and a front wall configured to diffuse light perpendicular to a surface of the front wall such that the light source light is substantially evenly emitted from the tube. The first endcap is coupled to the first tube end and has a reflective inner surface. The second endcap is coupled to the second tube end. The second endcap is fabricated from a translucent material.

In another aspect, a light column assembly for a refrigerator including a cabinet and at least one liner therein defining a refrigeration compartment having an inner surface is provided. The light column assembly includes a hollow tube, a first endcap, a second endcap, a first optical lighting film, a second optical lighting film, and a light source. The hollow tube includes a rear wall with an inner surface, and a front wall extending opposite the rear wall. The first endcap is coupled to the first tube end and is coupled to the liner inner surface. The first endcap has a reflective inner surface adjacent the first tube end. The second endcap is coupled to the second tube end and is coupled to the liner inner surface. The second endcap is fabricated from a translucent material. The first optical lighting film is adjacent the tube rear wall. The second optical lighting film is adjacent the tube front wall. The light source is positioned to direct a light beam having a predetermined beam spread angle through the second endcap at the first endcap inner surface such that the light source light is substantially evenly emitted from the tube.

DETAILED DESCRIPTION

Figure 1:
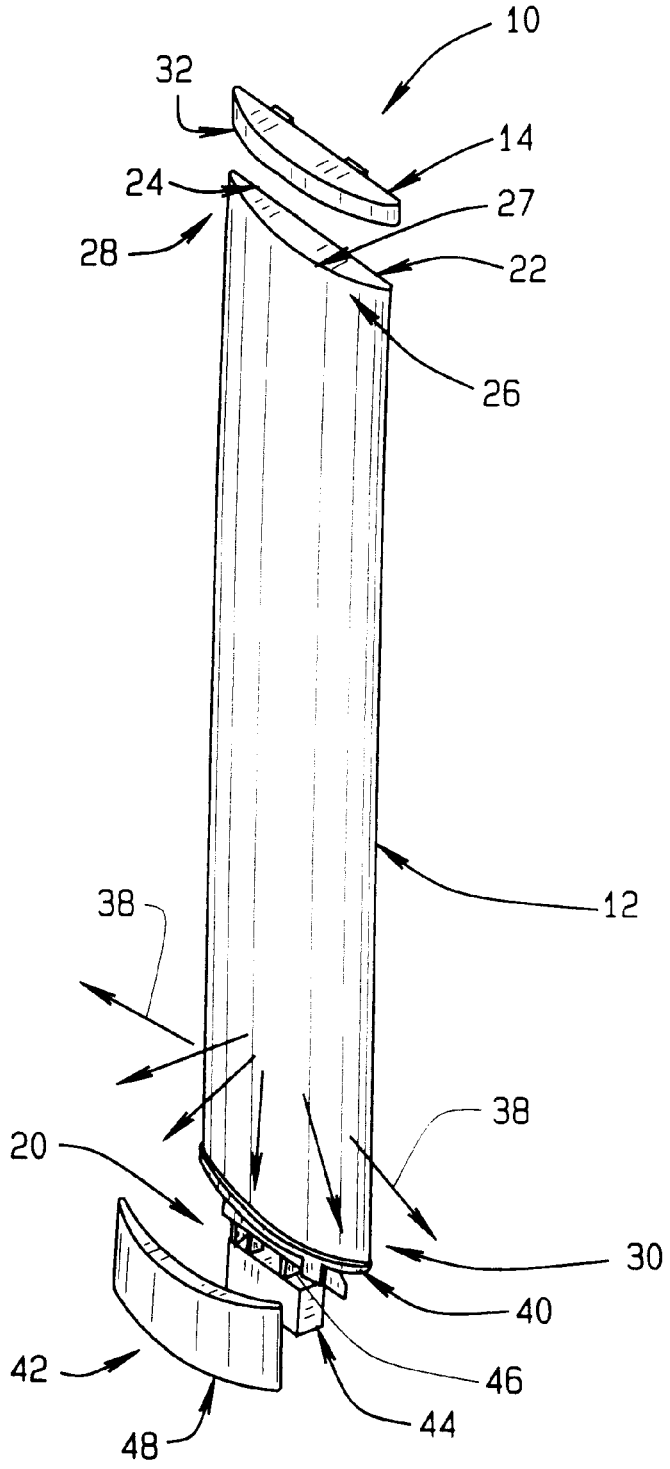
FIG. 1 is an exploded perspective view of a light column assembly.

FIG. 1 is an exploded perspective view of a light column assembly 10 including a hollow tube 12, first endcap 14, a first optical lighting film 16 (not shown in FIG. 1), a second optical lighting film 18 (not shown in FIG. 1), and at least one light source 20. Tube 12 includes a rear wall 22 with an inner surface 24, and a front wall 26 that extends opposite rear wall 22. Tube front wall 26 has an inner surface 27. In an exemplary embodiment, tube front wall 26 has an arcuate shape. In alternative embodiments, tube front wall 26 and tube rear wall 22 define a perimeter that forms a shape that includes, but is not limited to, a triangle, a square, a parallelogram, a trapezoid, or other multi-sided figure. Tube 12 also includes a first end 28, and a second end 30. First endcap 14 is coupled to tube first end 28 and has a reflective inner surface 32.

In an exemplary embodiment, first optical lighting film 16 overlies tube rear wall 22 at tube rear wall inner surface 24. Second optical lighting film 18 overlies tube front wall 26 at tube front wall inner surface 27. Light source 20 is coupled to tube second end 30 and is positioned to direct a light beam 34 (not shown in FIG. 1) having a predetermined beam spread angle 36 (not shown in FIG. 1) toward first endcap 14 such that a light source light 38 is substantially evenly emitted from tube 12 through tube front wall 26.

In an exemplary embodiment, light column assembly 10 also includes a second endcap 40 that is coupled to tube second end 30 between light source 20 and tube 12. Second endcap 40, first endcap 14, and tube 12 form a seal that facilitates preventing particles outside of tube 12 from entering tube 12. Additionally, in an exemplary embodiment, second endcap 40 is fabricated from a transparent material, including, but not limited to, a polycarbonate resin material such as a Lexan ® material commercially available from General Electric Corporation, New York, N.Y., or other similar material, which facilitates allowing light beam 34 from light source 20 to pass through second endcap 40 and into tube 12.

Light column assembly 10 also includes a light source housing assembly 42 that includes a light source holder 44, at least one light source socket 46, a light source cover 48, and light source 20. In an exemplary embodiment, light source housing assembly 42 is coupled to second endcap 40 and is positioned to direct a light beam 34 having a predetermined beam spread angle 36 toward first endcap 14 such that light source light 38 is substantially evenly emitted from tube 12 through tube front wall 26. In an exemplary embodiment, light source cover 48 is coupled to light source holder 44 with known fasteners and can be removed to allow easy access to light source 20 and light source socket 46. In another embodiment, light source cover 48 is coupled to light source holder 44 with known fasteners and is configured to allow easy access to light source 20 and light source socket 46. In an alternative embodiment, light source housing assembly 42 further includes a hinge (not shown) connected to light source holder 44 so that light source cover 48 can be hingedly connected to light source holder 44 and tiltable relative to light source holder 44 allowing easy access to light source 20 and light source socket 46. The embodiments shown herein for connecting light source cover 48 to light source holder 44 to allow access to light source 20 and light source socket 46 are only intended to be illustrative. Other embodiments of connecting light source cover 48 to light source holder 44 to allow access to light source 20 and light source socket 46 can also be utilized.

First optical lighting film 16 overlies tube rear wall 22 at tube rear wall inner surface 24. First optical lighting film 16 is configured to facilitate a substantially even distribution of light source light 38 from tube first end 28 to tube second end 30, and reflect light source light 38 substantially perpendicular to tube rear wall 22 toward tube front wall 26. In an exemplary embodiment, first optical lighting film 16 is a known film manufactured by Minnesota Mining and Manufacturing Company (3M ™) of St. Paul, Minn. such as for example, Optical Grade Polycarbonate 3M ™ Specification 2301 that has a dot pattern on the back of the film. The dot pattern facilitates light from light source 20, which is positioned on tube second end 30, to be evenly distributed within tube 12 such that light 38 emitted from tube 12 has a substantially even intensity along tube 12. In an alternative embodiment, an alternative film is applied to tube rear wall 22 having similar light reflective properties as described hereinabove such that the alternative film is configured to facilitate a substantially even distribution of light source light 38 from tube first end 28 to tube second end 30, and reflect light source light 38 substantially perpendicular to tube rear wall 22 toward tube front wall 26. In yet another alternative embodiment, light column assembly 10 includes a rear wall 22 that is manufactured with the light reflective properties described hereinabove for first optical lighting film 16 such that alternative rear wall 22 is configured to facilitate a substantially even distribution of light source light 38 from tube first end 28 to tube second end 30, and reflect light source light 38 substantially perpendicular to tube rear wall 22 toward tube front wall 26.

In an exemplary embodiment, first optical lighting film 16 is coupled to tube rear wall inner surface 24 with a plurality of guides 52 (shown in FIG. 3), which are integral to tube 12. In an alternative embodiment, first optical lighting film 16 is coupled to tube rear wall inner surface 24 using other types of known fasteners that are either integral to or separate from tube 12, including, but not limited to, clips, tabs, or brackets. In another alternative embodiment, first optical lighting film 16 is coupled to tube rear wall inner surface 24 using a chemical fastener, including, but not limited to, an adhesive or a glue. In yet another alternative embodiment, first optical lighting film 16 is coupled to an outside surface of tube rear wall 22 with a mechanical or chemical fastener.

Second optical lighting film 18 overlies tube front wall 26 at tube front wall inner surface 27. Second optical lighting film 18 is configured to diffuse light source light 38 perpendicular to tube front wall 26 such that light source light 38 is substantially evenly emitted from tube 12. Second optical lighting film 18 is also configured to reflect a portion of light source light 38 that does not pass through second optical lighting film 18 toward first optical lighting film 16, which reflects this portion of light source light 38 back to second optical lighting film 18 such that this portion of light source light 38 is diffused and emitted perpendicular to tube front wall 26. In an exemplary embodiment, second optical light film 18 is a known film manufactured by Minnesota Mining and Manufacturing Company (3M ™) of St. Paul, Minn. such as for example, Optical Grade Polycarbonate 3M ™ Specification 2301. In an alternative embodiment, an alternative film is coupled to tube front wall inner surface 27 having similar light diffusion and reflective properties as described hereinabove such that the alternative film is configured to diffuse light source light 38 perpendicular to tube front wall 26 so that light source light 38 is substantially evenly emitted from tube 12. In yet another alternative embodiment, light column assembly 10 includes a front wall 26 that is manufactured with the light diffusion and reflective properties described hereinabove for second optical lighting film 18 such that alternative rear wall 26 is configured to diffuse light source light 38 perpendicular to tube front wall 26 so that light source light 38 is substantially evenly emitted from tube 12.

In an exemplary embodiment, second optical lighting film 18 is coupled to tube front wall inner surface 27 with a plurality of guides 52 (shown in FIG. 3), which are integral to tube 12. In an alternative embodiment, second optical lighting film 18 is coupled to tube front wall inner surface 27 using other types of known fasteners that are either integral to or separate from tube 12, including, but not limited to, clips, tabs, or brackets. In another alternative embodiment, second optical lighting film 18 is coupled to tube front wall inner surface 27 using a chemical fastener, including, but not limited to, an adhesive or a glue. In yet another alternative embodiment, second optical lighting film 18 is coupled to an outside surface of tube front wall 26 with a mechanical or chemical fastener.

Light source 20 is coupled to tube second end 30 and is positioned to direct a light beam 34 having predetermined beam spread angle 36 toward first endcap 14 such that light source light 38 is substantially evenly emitted from tube 12 through tube front wall 26. Predetermined beam spread angle 36 ranges between 5 degrees and 30 degrees. In an exemplary embodiment, light source 20 includes two known halogen lamps 54 (shown in FIG. 2) wherein each lamp 54 has a beam spread angle 56 (shown in FIG. 2) of about 17 degrees and a diameter 58 (shown in FIG. 2). One such exemplary lamp found to be suitable for the present invention includes General Electric Halogen Dichroic Product Code 35077, Precise Bright MR-11, 35 watts, 35 mm diameter, closed, Cap-GU4/B15B, spot angle less than 20 degrees, commercially available from General Electric Corporation, New York, N.Y.

In an exemplary embodiment of light column assembly 10, first endcap reflective inner surface 32 is a polished opaque surface. In an alternative embodiment of light column assembly 10, first endcap reflective inner surface 32 is a chrome plated surface.

In an exemplary embodiment of light column assembly 10, tube 12 includes an aperture 60 (shown in FIG. 3) that has a maximum height 62 (shown in FIG. 3) less than lamp diameter 58 which facilitates a smaller tube 12 with improved illumination. In an alternative embodiment of light column assembly 10, aperture 60 has a maximum height 62 that is greater than or equal to lamp diameter 58.

In operation, an exemplary embodiment employs two halogen lamps 54 as light source 20. Light source 20 is coupled to tube second end 30 and positioned to direct light beams 34 from halogen lamps 54 having beam spread angle 56 of about 17 degrees through translucent second endcap 40 at first endcap reflective inner surface 32. As light beams 34 enter tube 12, a portion of light beams 34 strikes second optical lighting film 18, which is coupled to tube front wall 26, and is diffused by second optical lighting film 18 such that this portion of the light is substantially evenly emitted from tube 12 perpendicular to tube front wall 26. A portion of light beams 34 that does not pass through second optical lighting film 18 is reflected toward first optical lighting film 16. A portion of light beams 34 strikes first optical lighting film 16, which is coupled to tube rear wall 22, and is evenly distributed from tube first end 28 to tube second end 30 by first optical lighting film 16, and reflected substantially perpendicular to tube rear wall 22 toward tube front wall 26. After this portion of light 38 is reflected by first optical lighting film 16 toward tube front wall 26, this portion of light 38 is diffused by second optical lighting film 18 such that light 38 is substantially evenly emitted from tube 12 perpendicular to tube front wall 26. Lastly, a portion of light beams 34 also strikes first endcap reflective inner surface 32 which reflects this portion of light 38 at first optical lighting film 16 and second optical lighting film 18. This portion of light 38 is then substantially evenly emitted from tube 12 perpendicular to tube front wall 26 by first optical lighting film 16 and second optical lighting film 18.

Figure 2:
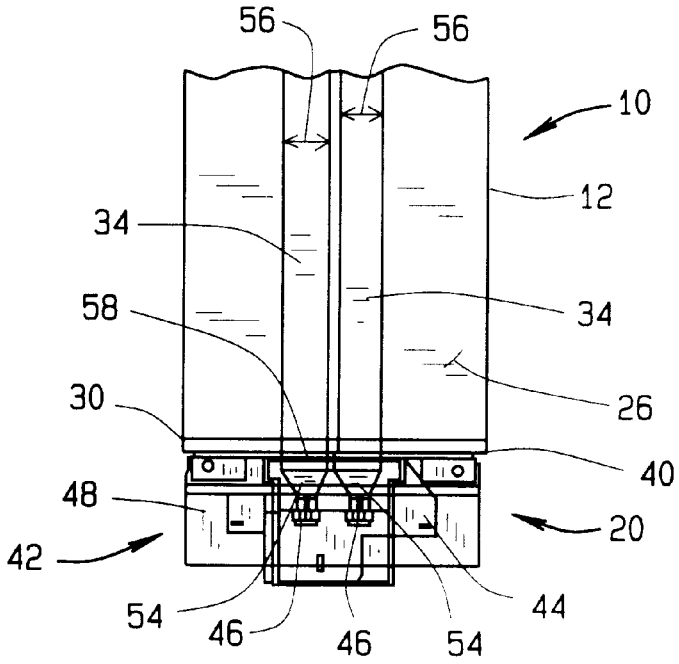
FIG. 2 is a partial front elevational view of the light column assembly shown in FIG. 1.

FIG. 2 is a partial front elevational view of light column 10. Light column assembly 10 includes hollow tube 12, first endcap 14 (not shown in FIG. 2), a first optical lighting film 16 (not shown in FIG. 2), a second optical lighting film 18 (not shown in FIG. 2), light source 20, and second endcap 40. Second endcap 40 is coupled to tube second end 30 between light source 20 and tube 12 and is fabricated from a transparent material, including, but not limited to, a polycarbonate resin material such as a Lexan ® material commercially available from General Electric Corporation, New York, N.Y., or other similar material, which facilitates allowing light beam 34 from light source 20 to pass through second endcap 40 and into tube 12.

Light source housing assembly 42 includes two halogen lamps 54, light source holder 44, two light source sockets 46 electrically connected to halogen lamps 54, and a light source cover 48. Light source housing assembly 42 is coupled to second endcap 40 and is positioned to direct light beams 34 from halogen lamps 54 through second endcap 40 and toward first endcap 14 (not shown in FIG. 2). Each halogen lamp has beam spread angle 56 of about 17 degrees which facilitates light column assembly 10 from emitting a substantially evenly emitted light 38 from tube 12 through tube front wall 26. Light source cover 48 is coupled to light source holder 44 with known fasteners and can be removed to allow easy access to lamps 54 and light source sockets 46. In another embodiment, light source cover 48 is coupled to light source holder 44 with known fasteners and is configured to allow easy access to light source 20 and light source socket 46. In an alternative embodiment, light source housing assembly 42 further includes a hinge (not shown) connected to light source holder 44 so that light source cover 48 can be hingedly connected to light source holder 44 and tiltable relative to light source holder 44 allowing easy access to lamps 54 and light source sockets 46. Other embodiments of connecting light source cover 48 to light source holder 44 to allow access to lamps 54 and light source sockets 46 can also be utilized.

Figure 3:
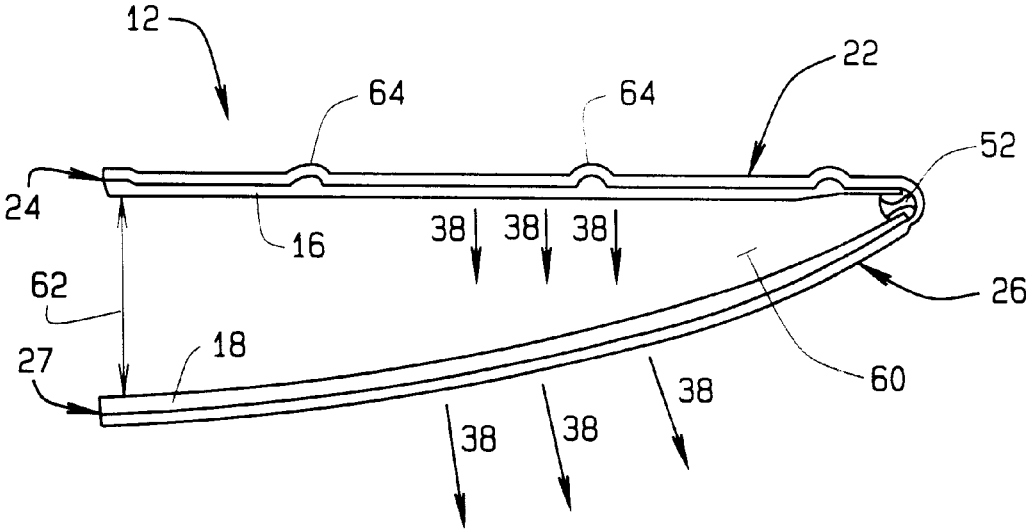
FIG. 3 is a partial top cross-sectional view of the hollow tube shown in FIG. 1.

FIG. 3 is a partial top cross-sectional view of hollow tube 12. Tube 12 has a rear wall 22 with an inner surface 24, and a front wall 26 that extends opposite rear wall 22. Tube front wall 26 has an inner surface 27. In an exemplary embodiment, tube front wall 26 has an arcuate shape. In alternative embodiments, tube front wall 26 and tube rear wall 22 define a perimeter that forms a shape that includes, but is not limited to, a triangle, a square, a parallelogram, a trapezoid, or other multi-sided figure. In an exemplary embodiment, tube rear wall 22 has a plurality of grooves 64 extending from tube first end 28 (not shown in FIG. 3) to tube second end 30 (not shown in FIG. 3) to add stiffness and strength to tube 12.

First optical lighting film 16 overlies tube rear wall 22 at tube rear wall inner surface 24. First optical lighting film 16 is configured to facilitate a substantially even distribution of light source light 38 from tube first end 28 to tube second end 30, and reflect light source light 38 substantially perpendicular to tube rear wall 22 toward tube front wall 26.

Second optical lighting film 18 overlies tube front wall 26 at tube front wall inner surface 27. Second optical lighting film 18 is configured to diffuse light source light 38 perpendicular to tube front wall 26 such that light source light 38 is substantially evenly emitted from tube 12. Second optical lighting film 18 is also configured to reflect the portion of light source light 38 that does not pass through second optical lighting film 18 toward first optical lighting film 16, which reflects this portion of light source light 38 back to second optical lighting film 18 such that this portion of light source light 38 is diffused and emitted perpendicular to tube front wall 26.

First optical lighting film 16 is coupled to tube rear wall inner surface 24 with a plurality of guides 52 integral to tube 12. Second optical lighting film 18 is coupled to tube front wall inner surface 27 with guides 52. In an alternative embodiment, first optical lighting film 16 is coupled to tube rear wall inner surface 24 and second optical lighting film 18 is coupled to tube front wall inner surface 27 using other types of known fasteners that are either integral to or separate from tube 12, including, but not limited to, clips, tabs, or brackets. In another alternative embodiment, first optical lighting film 16 is coupled to tube rear wall inner surface 24 and second optical lighting film 18 is coupled to tube front wall inner surface 27 using a chemical fastener, including, but not limited to, an adhesive or a glue. In yet another alternative embodiment, first optical lighting film 16 is coupled to the outside surface of tube rear wall 22 and second optical lighting film 18 is coupled to the outside surface of tube front wall 26 with a mechanical or chemical fastener.

In an exemplary embodiment of light column assembly 10, tube 12 includes an aperture 60 that has a maximum height 62 less than lamp diameter 58 which facilitates a smaller tube 12 with improved illumination. In an alternative embodiment of light column assembly 10, aperture 60 has a maximum height 62 that is greater than or equal to lamp diameter 58.

Figure 4:
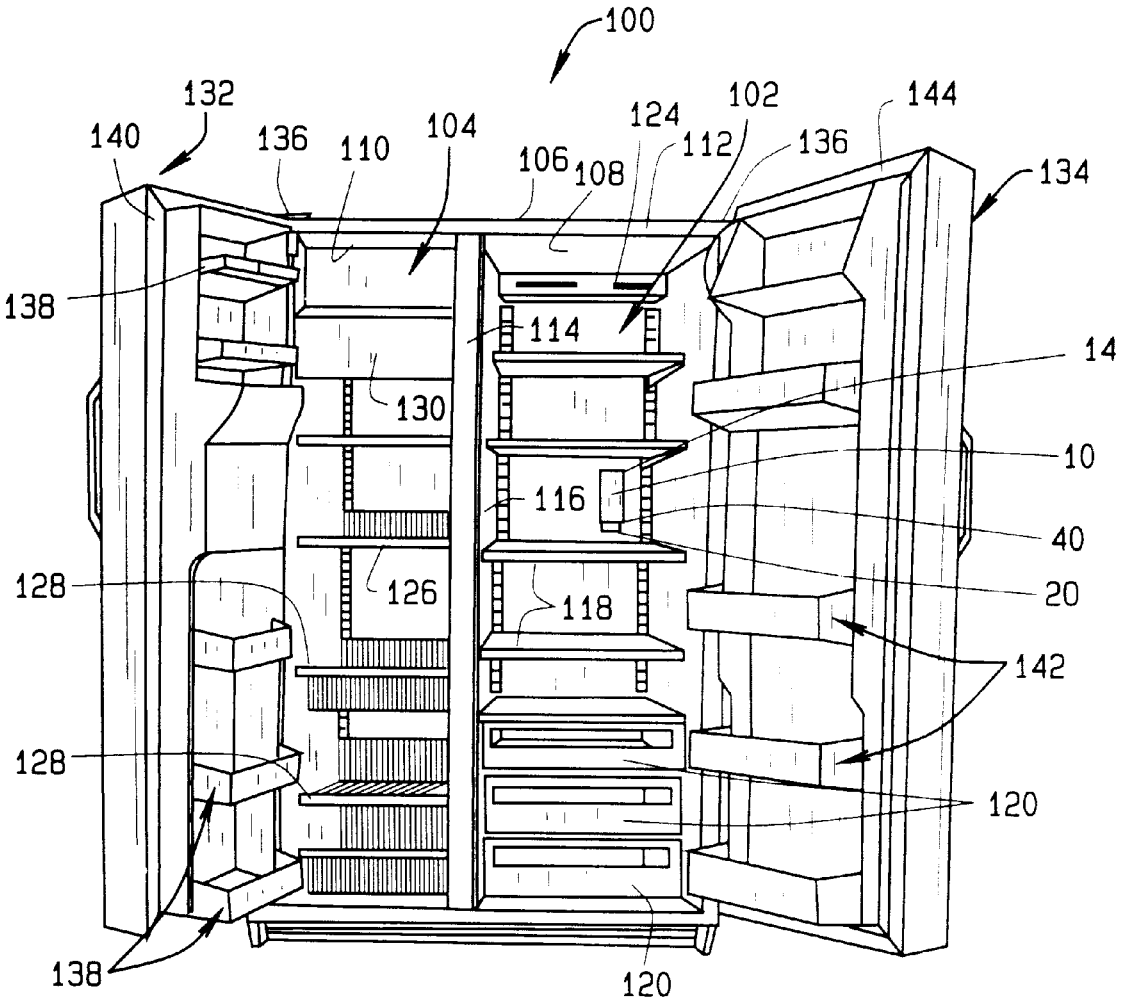
FIG. 4 is a front elevational view of a refrigeration appliance that illustrates an exemplary embodiment of the light column assembly shown in FIG. 1.

FIG. 4 illustrates an exemplary refrigeration appliance 100 in which the present invention may be practiced. Components shown in FIG. 4 that are identical to components shown in FIGS. 1–3 are identified in FIG. 4 using the same reference numerals used in FIGS. 1–3. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect. Moreover, the present invention, light column assembly 10, can be utilized in other applications that are not related to a refrigeration appliance. Illustrating light column assembly 10 within refrigeration appliance 100 is in no way limiting to its application in other areas.

Refrigerator 100 includes a fresh food storage compartment 102 and a freezer storage compartment 104. Freezer compartment 104 and fresh food compartment 102 are arranged side-by-side within an outer case 106 and defined by inner liners 108 and 110 therein. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108,110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out storage drawers 120, sometimes referred to as storage pans, normally are provided in fresh food compartment 102 to support items being stored therein.

A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality, of storage shelves 142 and a sealing gasket 144.

In at least some known refrigeration appliances, lighting devices are positioned within the refrigeration appliance to illuminate the compartments so that a user can more easily see the items within the refrigeration compartments. In an exemplary embodiment, light column assembly 10 is shown installed within fresh food storage compartment 102. More specifically, light column assembly is positioned within fresh food storage compartment 102 such that tube rear wall 22 (not shown in FIG. 4) is adjacent fresh food compartment inner liner 108. First endcap 14 and second endcap 40 on light column assembly 10 are coupled to fresh food compartment inner liner 108. Light column assembly 10 is electrically connected to a power source (not shown) which provides an electric current to light column assembly 10 when fresh food compartment door 134 is in the open position. The electric current causes light column assembly to be illuminated by light source 20 as described hereinabove producing a substantially even distribution of light from tube 12 that illuminates fresh food compartment 102.

The embodiment shown in FIG. 4 is provided for illustrative purposes only, and the invention is in no way intended to be restricted to practice in any particular location in a refrigeration compartment. In alternative embodiments, light column assembly 10 is located in another location within fresh food compartment 102; a plurality of light column assemblies 10 are positioned in fresh food compartment 102; or light column assembly 10 is installed within freezer compartment 104.

The present invention emits a substantially even amount of light throughout the light column such that the compartments within a refrigeration appliance are evenly illuminated with a relatively few number of lighting devices.

While the invention has been described in terms of various specific embodiments, those skilled in the art will recognize that the invention can be practiced with modification within the spirit and scope of the claims.

What is claimed is:

1. A light column assembly comprising:

a hollow tube comprising a rear wall having an inner surface, and a front wall extending opposite said rear wall and having an inner surface, said tube further comprising a first end and a second end;

a first endcap coupled to said tube first end and comprising a reflective inner surface;

a first optical lighting film overlying said tube rear wall;

a second optical lighting film overlying said tube front wall; and at least one light source coupled to said tube second end and positioned to direct a light beam having a predetermined beam spread angle toward said first endcap such that said light source light is substantially evenly emitted from said tube through said tube front wall.

2. A light column assembly in accordance with claim 1 further comprising a second translucent endcap coupled to said tube second end between said light source and said tube.

3. A light column assembly in accordance with claim 2 wherein said tube, said first endcap, and said second endcap form a seal such that particles are prevented from entering said tube.

4. A light column assembly in accordance with claim 1 wherein said first endcap reflective inner surface comprises a chrome plated surface.

5. A light column assembly in accordance with claim 1 wherein said first endcap reflective inner surface comprises a polished opaque surface.

6. A light column assembly in accordance with claim 1 wherein said first optical lighting film is coupled to said tube rear wall inner surface and configured to:

facilitate a substantially even distribution of said light source light from said tube first end to said tube second end; and reflect said light source light substantially perpendicular to said tube rear wall toward said tube front wall.

7. A light column assembly in accordance with claim 1 wherein said second optical lighting film is coupled to said tube front wall inner surface and configured to diffuse said light source light perpendicular to said tube front wall such that said light source light is substantially evenly emitted from said tube.

8. A light column assembly in accordance with claim 1 wherein said light source comprises at least one lamp having a beam spread angle ranging between 5 degrees and 30 degrees.

9. A light column assembly in accordance with claim 8 wherein said at least one lamp having a beam spread angle ranging between 10 degrees and 25 degrees.

10. A light column assembly in accordance with claim 9 wherein said at least one lamp having a beam spread angle ranging between 15 degrees and 20 degrees.

11. A light column assembly in accordance with claim 8 wherein said at least one lamp having a beam spread angle of about 17 degrees.

12. A light column assembly for a refrigeration appliance having an inner surface, said light column assembly comprising:

a light source including a light beam having a predetermined beam spread angle;

a hollow tube positioned adjacent said light source and positioned to direct said light source light into said tube, said tube comprising a first end, a second end, a rear wall configured to evenly distribute said light source light from said tube first end to said tube second end, and a front wall configured to diffuse light perpendicular to a surface of said front wall such that said light source light is substantially evenly emitted from said tube;

a first endcap coupled to said first tube end and comprising a reflective inner surface; and a second endcap coupled to said second tube end, said second endcap fabricated from a translucent material.

13. A light column assembly in accordance with claim 12 wherein at least one of said first and second endcaps is coupled to said refrigeration appliance inner surface.

14. A light column assembly in accordance with claim 12 wherein said first endcap reflective inner surface comprises a chrome plated surface.

15. A light column assembly in accordance with claim 12 wherein said first endcap reflective inner surface comprises a polished opaque surface.

16. A light column assembly in accordance with claim 12 wherein said tube rear wall is configured to reflect said light source light substantially perpendicular to said tube rear wall toward said tube front wall.

17. A light column assembly in accordance with claim 12 wherein said light source comprises at least one halogen lamp having a beam spread angle ranging between 5 degrees and 30 degrees.

18. A light column assembly in accordance with claim 17 wherein said at least one lamp having a beam spread angle ranging between 10 degrees and 25 degrees.

19. A light column assembly in accordance with claim 18 wherein said at least one lamp having a beam spread angle ranging between 15 degrees and 20 degrees.

20. A light column assembly in accordance with claim 17 wherein said at least one lamp having a beam spread angle of about 17 degrees.

21. A light column assembly for a refrigerator including a cabinet and at least one liner therein defining a refrigeration compartment having an inner surface, said light column assembly comprising:

a hollow tube comprising a rear wall having an inner surface, and a front wall extending opposite said rear wall;

a first endcap coupled to said first tube end and coupled to said liner inner surface, said first endcap comprising a reflective inner surface adjacent said first tube end;

a second endcap coupled to said second tube end and coupled to said liner inner surface, said second endcap fabricated from a translucent material;

a first optical lighting film adjacent said tube rear wall;

a second optical lighting film adjacent said tube front wall; and a light source positioned to direct a light beam having a predetermined beam spread angle through said second endcap at said first endcap inner surface such that said light source light is substantially evenly emitted from said tube.

22. A light column assembly in accordance with claim 21 wherein said first optical lighting film is coupled to said tube rear wall inner surface and configured to:

facilitate a substantially even distribution of said light source light from said tube first end to said tube second end; and reflect said light source light substantially perpendicular to said tube rear wall toward said tube front wall.

23. A light column assembly in accordance with claim 21 wherein said tube front wall further comprises an inner surface facing said tube rear wall inner surface.

24. A light column assembly in accordance with claim 23 wherein said second optical lighting film is coupled to said tube front wall inner surface and configured to diffuse said light source light perpendicular to said tube front wall such that said light source light is substantially evenly emitted from said tube.

25. A light column assembly in accordance with claim 21 wherein said light source comprises at least one lamp having a beam spread angle of about 17 degrees.

26. A light column assembly in accordance with claim 24 wherein said tube front wall has an arcuate shape.

* * * * *